United States Patent [19]

Eriksson

[11] Patent Number: 4,699,066

[45] Date of Patent: Oct. 13, 1987

[54] LINEAR EXPLOSIVE SEPARATION SYSTEM

[75] Inventor: Theodore L. Eriksson, Brigham City, Utah

[73] Assignee: Morton Thiokol Inc., Chicago, Ill.

[21] Appl. No.: 791,632

[22] Filed: Oct. 25, 1985

[51] Int. Cl.[4] ..... F42B 1/00

[52] U.S. Cl. ..... 102/305; 102/307; 102/309; 102/312; 89/1.14

[58] Field of Search ..... 102/305, 307, 308, 312, 102/313, 376; 89/1.14

[56] References Cited

U.S. PATENT DOCUMENTS

| | | | |
|---|---|---|---|
| 1,531,555 | 3/1925 | Harris et al. | 89/1.14 |
| 2,758,543 | 8/1956 | Grandin | 102/21.6 |
| 2,926,604 | 3/1960 | MacLeod | 102/701 X |
| 3,076,408 | 2/1963 | Poulter | 102/23 |
| 3,373,686 | 3/1968 | Blain et al. | 102/22 |
| 3,435,763 | 4/1969 | Lavine | 102/701 X |
| 3,486,410 | 12/1969 | Drexelius | 89/1 |
| 3,728,965 | 4/1973 | Silvia | 102/701 X |
| 3,741,123 | 6/1973 | Dittrich | 102/701 X |
| 3,838,643 | 10/1974 | Austin et al. | 102/307 |
| 3,971,290 | 7/1976 | Blain | 89/1 |
| 4,091,870 | 5/1978 | Godfrey et al. | 102/701 X |
| 4,408,535 | 11/1983 | Alford | 102/35 |

*Primary Examiner*—Peter A. Nelson

*Attorney, Agent, or Firm*—Gerald K. White

[57] ABSTRACT

A linear explosive separation system includes two intersecting surfaces that are formed on a structural plate or other member consisting of isotropic material such as metal and offset from each other at an angle substantially less than 180°, and an explosive charge placed in a groove in intimate contact with the surface thereof, which groove is spaced from and parallel to the offset surfaces and so placed as to be nominally centered on the bisector of the angle formed by the offset surfaces.

5 Claims, 16 Drawing Figures

LINEAR EXPLOSIVE SEPARATION SYSTEM

BACKGROUND OF THE INVENTION

1. Field of the Invention

The present invention relates to the art of explosively breaking or cutting solid materials, and has particular, although not exclusive, application for the breaking or cutting of metals for the separation of components of an integral structure.

2. Description of the Prior Art

Explosives are used as convenient sources of energy which can be suddenly released to perform work on solid materials. Uncontrolled fracturing of solids by means of explosives has been accomplished by various methods such as shattering by brute force using a large amount of explosive. Thus, a simple known explosive charge is the "plaster charge" which consists of a mass of high explosive in a compact or linear configuration and which is placed in intimate contact with the surface of a solid body of material, for example, a metal plate, upon which work is to be performed. When the charge is detonated, a shock wave travels through the plate. Provided a medium, such as air, of lower density than the metal plate is in contact with the opposite side of the plate, the shock wave is reflected back from the interface between the plate and such medium. In the process the shock wave undergoes a phase inversion so that a compression wave travelling towards the interface is reflected back as a tension or stretching wave. The actual pressure within the plate at a given point is a summation of the compression and the tension waves.

Plaster charges tend to cause a flake of metal to be torn from the plate on the side thereof opposite to that against which the charge was placed. If sufficient explosive is used, the metal plate may be weakened to such an extent that residual explosive pressure blows a hole through or severs the plate. The use of plaster charges, although simple, requires large amounts of explosive, produces very ragged cuts, causes distortion of the metal adjacent the cut and may result in the projection of destructive fragments of metal.

Various proposals, as disclosed in the following U.S. Patents have been made in the prior art for imparting directionality to the energy release occurring upon the detonation of explosives to perforate, distort, fracture, cut or otherwise modify the shape of solid metal of other hard materials: U.S. Pat. Nos. 1,531,555 granted Mar. 31, 1925 to J. W. Harris, et al; 2,758,543 granted Aug. 14, 1956 to C. W. Grandin; 3,076,408 granted Feb. 5, 1963 to T. C. Poulter, et al; 3,971,290 granted July 17, 1976 to J. W. Blain; 3,373,686 granted Mar. 19, 1968 to J. W. Blain, et al; 4,408,535 granted Oct. 11, 15 1983 to S. C. Alford; 3,486,410 granted Dec. 30, 1969 to V. W. Drexelius, et al.

Thus, a method of more precisely cutting a body of solid metal is by means of shaped charges such as linear cutting charges. A linear cutting charge, in a preferred form, comprises a length of metal which is semi-circular or V-shaped in cross section and an explosive which extends the length of the metal and which is capable of sustaining detonation with a high velocity of propagation. The length of metal is arranged with the hollow side thereof directed towards and spaced away from the solid body on which work is to be performed while the explosive extends centrally of and in contact with the opposite side of the length of metal. With a semicircular section length of metal, the explosive, when detonated, acts to turn the length of metal inside out and project it as a high velocity metal jet at the solid body upon which work is to be performed, the latter thus being severed if the explosive charge is sufficiently powerful. In the case of a V-section length of metal, the pressure exerted by the explosive when detonated, serves to drive the two limbs of the V-section length of metal towards one another at high velocity so that they collide. As a result of the collision of the two limbs, a small part of each of the limbs is stripped off and is projected at the solid metal body on which work is being performed as an extremely fast-moving blade-like jet which is capable of producing a very deep and narrow cut in the solid metal body for a given amount of explosive.

Shaped charges generally produce deeper cuts with less explosive and cause less damage to the solid body on which work is being performed than plastic charges. Shaped charges suffer from disadvantages, however. If the explosive charge is not matched to the metal and thickness of the solid body upon which work is to be performed so as to just cut through the solid body, then the extremely fast moving metal jets produced by the shaped charges can cause considerable damage beyond the solid body upon which work is being performed. Another disadvantage is that the shaped charge has to be spaced from the solid body by a distance of about one or two charge widths, sufficient to allow the aforesaid high velocity jets to develop. A further disadvantage with shaped charges is that those used for producing deep cuts of a centimeter or more are invariably rigid and cannot be bent to follow the contour of a solid body having a curved surface or to produce a cut other than that for which the charge was designed, that is, a non-rectilinear cut in the case of a rectilinear charge.

Linear shaped charges fully encased in a metal sheath are also known. Such charges, however, produce high velocity destructive fragments which are propelled away from the direction of the desired cut. In order to preclude damage from such fragments, relatively heavy protective structures are required to shield and protect personnel as well as sensitive material and components. Pressure fracturing requires relatively heavy backup structures to contain the explosive backblast and to maintain sufficient pressure to obtain the desired fracturing effect with a minimum amount of explosive. In any system where weight is a consideration, this is a serious disadvantage.

Thus, there is a need and a demand for an improved lightweight linear explosive system for the breaking and cutting of metals for the separation of components of an integral structure, whether flat or curved, and which is operative to impart directionality to the energy release thereby to provide a single fracture line with little or no resulting fragments or other debris.

SUMMARY OF THE INVENTION

An object of the invention is to provide an improved linear explosive separation system for imparting directionality to an explosive energy release for the purpose of separating components of an integral structure.

Another object of the invention is to provide such an improved linear explosive separation system which is compact and lightweight and which is operative to provide a single fracture line with little or no fragments thereby eliminating the need for relatively heavy backup or protective structures.

In accomplishing these and other objectives of the invention, there is provided a grooved, notched or offset plate of normally solid substance flowable under extreme pressure, such as metal, with a linear detonating explosive charge located in a second parallel groove, in intimate contact with the surface thereof, on the opposite side of the plate and lying nominally centered on the bisector of the angle formed by the offset, such that the detonation of the explosive results in tensile fracture originating at the outer corner of the opposing offset. The solid plate to be separated may be flat or curved.

The principle of operation of the present invention is the high tensile stress produced at the intersection of shock waves from the sides of the "ridge" formed by the offset. Specifically, the compressive shock wave produced upon detonation of the explosive charge expands, and when reaching each of the sides of the "ridge" formed by the offset, is reflected as a contracting tensile wave. The tensile shock waves reflected by the sides of the ridge are caused to intersect in a reinforcing manner resulting in a fracture of the plate at the plane of intersection, specifically the plane bisecting the angle of the offset. There is an accompanying upward deflection of the plate and offset due to the reactive force of the detonating explosive charge. The fracture mechanism is enhanced by the sidewards momentum imparted to the opposite sides of the second parallel groove.

It is to be understood, however, that the present invention is not to be limited to such theory or explanation. Also, such theory or explanation, however sound or valid, is not to be construed as necessarily constituting a full and complete explanation of what occurs during the fracturing process. The present invention resides in the novel manner of efficiently utilizing the energy of an explosive charge to cause precisely controlled fracturing of a solid body of hard material, such as steel or the like, along a predetermined internal plane.

The various features of novelty which characterize the present invention are pointed out with particularity in the claims annexed to and forming a part of this specification. For a better understanding of the invention, its operating advantages, and specific objects attained by its use, reference is made to the accompanying drawings and descriptive matter in which a preferred embodiment of the invention is illustrated.

DESCRIPTION OF THE PREFERRED EMBODIMENTS

Figure 1:
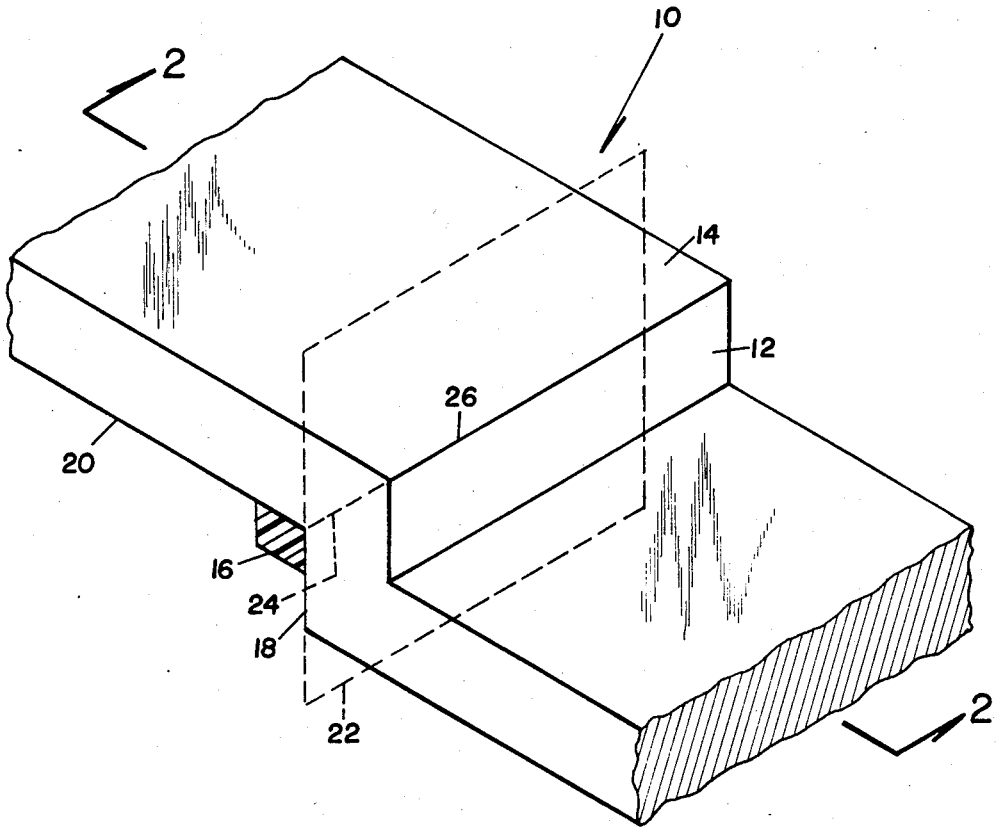
FIG. 1 is a fragmentary perspective view of a grooved, notched or offset solid plate prepared for a fracturing operation with a linear explosive charge located in a second parallel groove on the opposite side of the plate and lying nominally centered on the bisector of the angle formed by the offset.

Referring now to FIG. 1, it will be seen that the linear explosive separation system of the invention includes a metal plate 10. Plate 10 has an offset 12 on a first side or surface 14 thereof, the offset 12 comprising, as shown, a step forming a substantially 90° angle in the surface 14 and extending across the width of plate 10. A linear explosive charge 16 is located in a second parallel groove 18 on a second or opposite side or surface 20 of plate 10, which second surface 20 is spaced from the first surface 14. That is to say, the groove 18 is positioned on the second surface 20 in a plane 22, indicated by dotted lines, that intersects in substantially a right angle the first surface 14 at a position that is spaced from offset 12, as shown in FIG. 1. The distance from the plane 22 to the offset 12 may be approximately the same as the distance between the first surface 14 and the second surface 20. Thus, groove 18 lies nominally centered on the bisector, indicated by the dotted line 24, of the angle formed by the offset 12.

Figure 2:
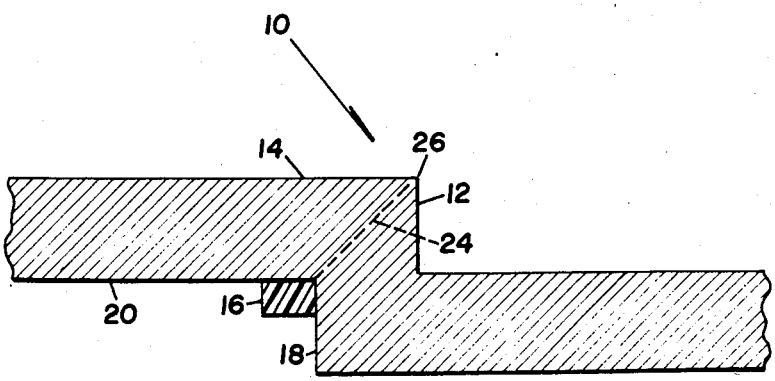
FIG. 2 is a cross sectional view taken along the lines 2—2 of FIG. 1.

With this arrangement, detonation of the explosive charge 16 results in a tensile fracture along the bisector 24, such fracture originating at the outer corner 26 of the opposing groove 12. The plate 10 may be flat or curved. The plate 10 of FIG. 1 has a cross section as shown in FIG. 2.

The manner in which detonation of explosive charge 16 causes tensile fracture along the dotted line 22 is illustrated by reference to FIGS. 3 through 7. Referring to drawings, it will be seen that when explosive charge 16 is detonated, shock waves are produced in the metal plate 10 along the length of the charge 16. These shock waves emanate from the points of explosive attack as expanding compressive waves and are reflected back from the sides of the ridge formed by offset 12 as contracting phase inverted tensile waves.

Figure 3:
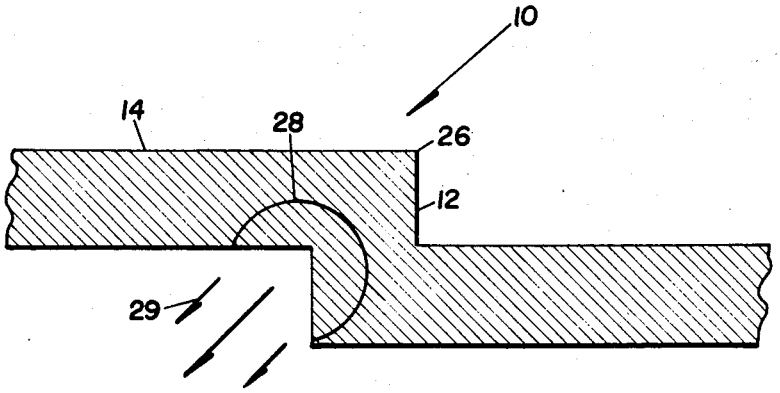
FIG. 3 is a schematic view similar to FIG. 2 depicting an early stage of the propagation of a compressive shock wave through the plate when the linear explosive is detonated in intimate contact with the surface of the second parallel groove.

Thus, FIG. 3 depicts an early stage of the propagation of a compressive wave 28 (shown as a solid line) through the plate 10, with explosive gases 29 being propelled in the opposite direction away from groove 18.

Figure 4:
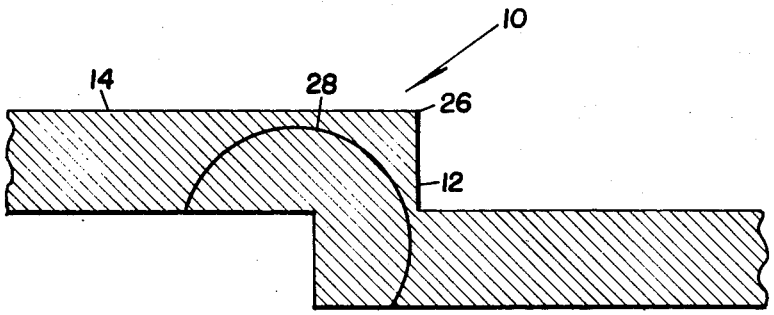
FIG. 4 is a view similar to FIG. 3 depicting a later stage of the propagation of compressive shock waves through the plate.
Figure 5:
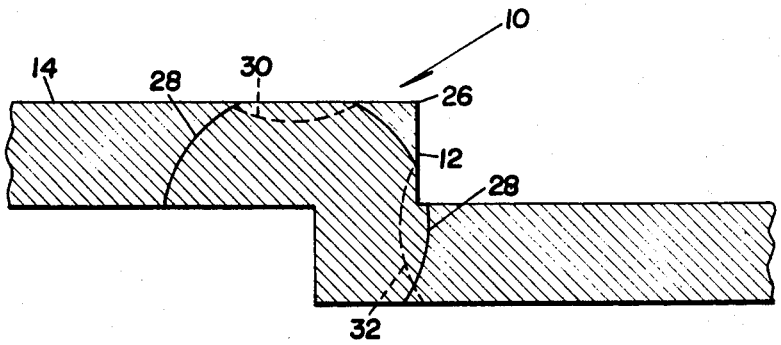
FIG. 5 is another view similar to FIG. 3 depicting a still later stage immediately following development of reflected tensile shock waves through the plate.

FIGS. 4 and 5 show later stages of the compressive wave 28 through the plate 10. In FIG. 4 the compressive wave 28 has not yet reached the opposite surfaces of offset 12. The compression wave 28, in FIG. 5, however, has reached the opposing sides of offset 12, with reflection tensile waves 30 and 32 (shown as dashed lines) being in an early stage. Thus, tensile wave 30 is reflected from the surface 14 side of offset 12 and tensile wave 32 is reflected from the vertical surface of offset 12. Note, however, the continued expansion of compressive wave 28 toward the opposite ends of plate 10.

Figure 6:
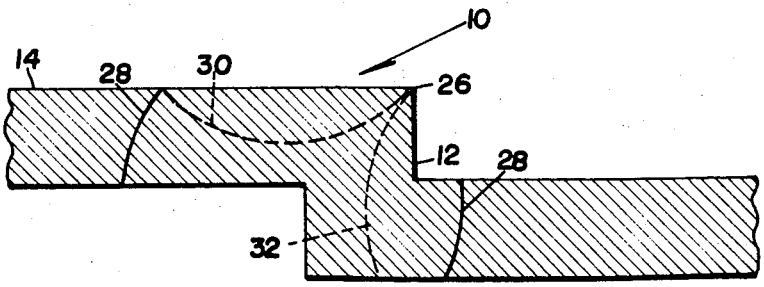
FIG. 6 is a further view similar to FIG. 3 depicting an even later stage just prior to the onset of the instantaneous condition when fracture occurs.
Figure 7:
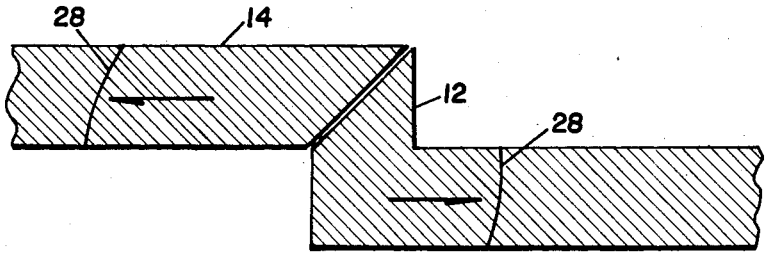
FIG. 7 is still another view similar to FIG. 3 depicting the condition upon completion of the fracture.

FIG. 6 depicts a later stage of the instantaneous condition showing the compressive wave 28 continuing to expand to the opposite ends of plate 10 and showing tensile waves 30 and 32 in plate 10 just coinciding along the bisector 24, beginning at the outer corner 26 of offset 12. As a result, each point along the plane containing bisector 24 is subjected to the destructive effects of the summated compression and tension waves, which, with a sufficient explosive charge 16, induce fracture from one side of the plate 10 to the other along the bisector 24, as illustrated in FIG. 7.

Figure 8:
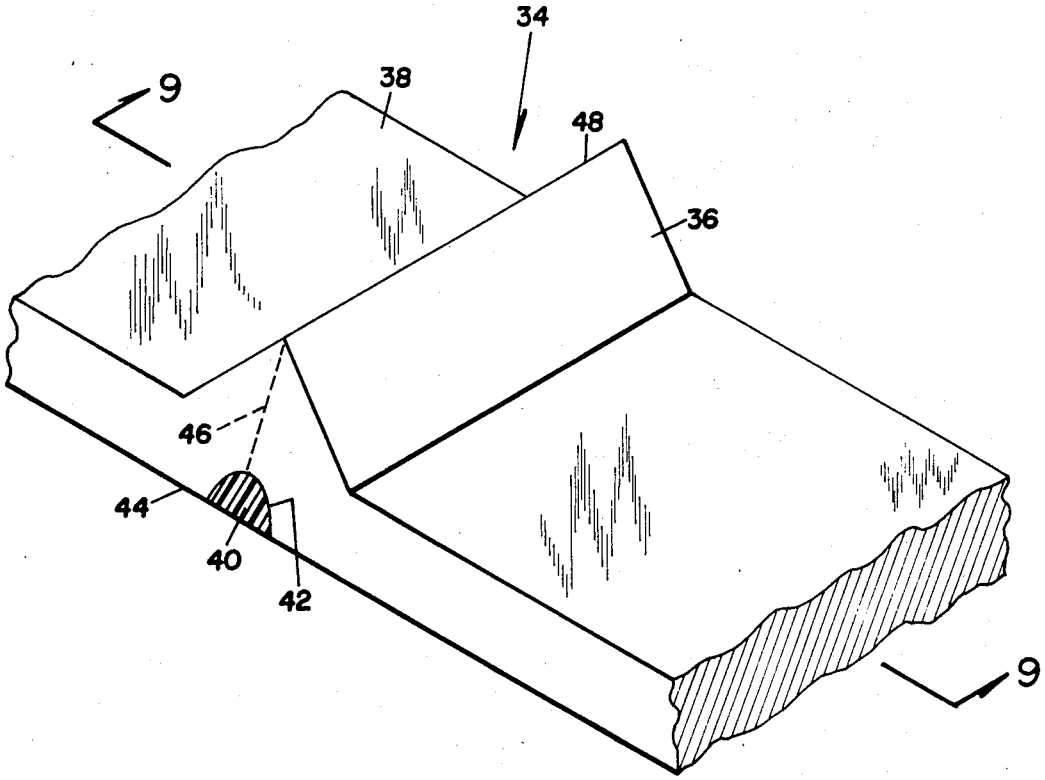
FIG. 8 is a fragmentary perspective view of another configuration, according to the invention, of an offset solid plate prepared for a fracturing operation with a linear explosive charge located in a parallel groove on the opposite side of the plate and lying nominally centered on the bisector of the angle formed by the offset.
Figure 9:
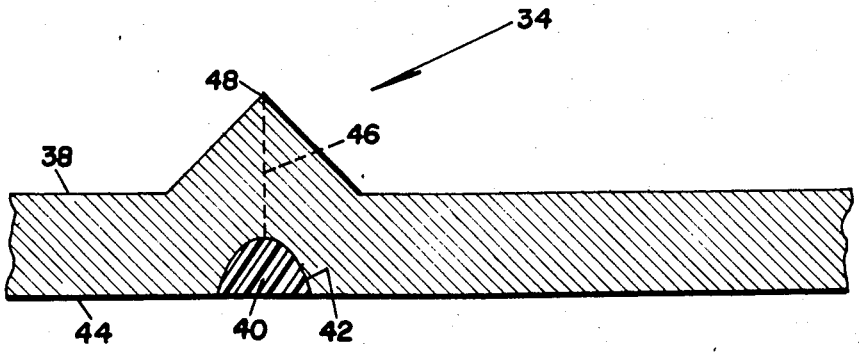
FIG. 9 is a cross sectional view taken along the lines 9—9 of FIG. 8.

Another configuration of the linear explosive system according to the invention is shown in FIG. 8. The system of FIG. 8 comprises a metal plate 34 having a linear offset 36 on one side, or first surface 38, which offset comprises a protuberance that is triangular in cross section and has upwardly extending sides of equal length extending across the width of plate 34. Plate 34, similarly to plate 10 of FIG. 1, may be comprised of a normally solid substance that is flowable under extreme pressure. A linear explosive charge 40 is located in a parallel groove 42 that is provided on the opposite side or second surface 44 of the plate 34, directly opposite to the offset 36 and lying nominally centered on the bisector, indicated by the dotted line 46, of the angle formed by the offset 36. Groove 42 may be semicircular in cross section, as shown in FIG. 9. As in the case of the system of FIG. 1, the plate 34 may be flat or curved. Detonation of the explosive charge 40 results in a tensile fracture along the dotted line 46, originating at the vertex 48 of the offset 36.

Figure 10:
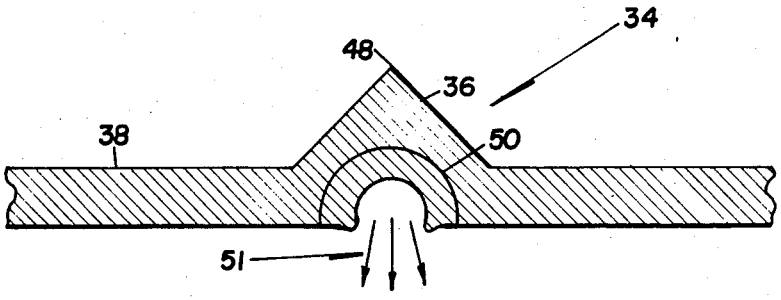
FIG. 10 is a schematic view similar to FIG. 9 depicting an early stage of the propagation of a compressive shock wave through the plate when the linear explosive is detonated in intimate contact with the surface of the parallel groove.

Specifically, by reference to FIGS. 10 through 16, it will be seen that when explosive charge 40 is detonated, shock waves are produced in the plate 34 along the length of the charge 40. Such shock waves emanate from the points of explosive attack as expanding compressive waves and are reflected back from the opposite and slanting sides of the offset 36 of plate 34 as contracting phase inverted tensile waves. FIG. 10 depicts an early stage of the propagation of a compressive wave 50 (shown as a solid line) through the plate 34, with explosive gases 51 being propelled away from groove 42.

Figure 11:
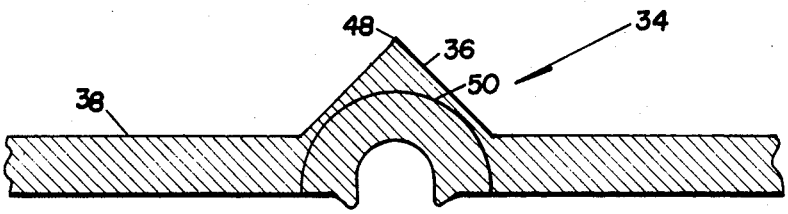
FIG. 11 is a view similar to FIG. 10 depicting a later stage of the propagation of compressive shock waves through the plate.
Figure 12:
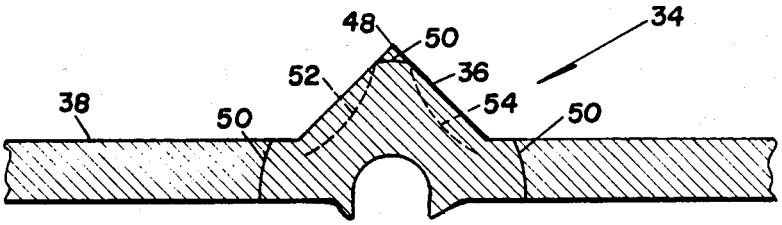
FIG. 12 is a view similar to FIG. 10 depicting a still later stage immediately following development of reflected tensile shock waves through the plate.

FIG. 11 and 12 show later stages of the compressive wave 50. Thus, in FIG. 11, the compressive wave 50 has not yet reached the opposite sides of the ridge formed by offset 36. In FIG. 12, the compressive wave 50 is depicted as having reached the opposing sides of the ridge formed by offset 36 with tensile waves 52 and 54 reflected therefrom being in an early stage and with the compressive wave 50 continuing to expand to the opposite ends of plate 34.

Figure 13:
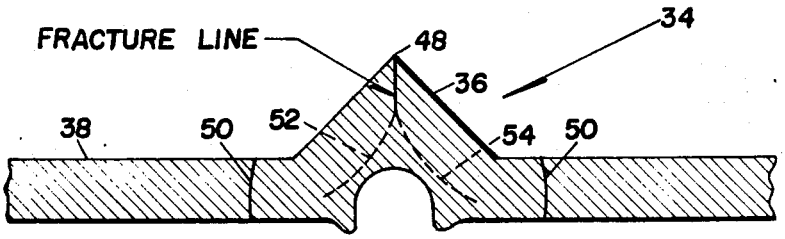
FIG. 13 is a view similar to FIG. 10 depicting an even later stage just prior to the onset of the instantaneous condition when fracture occurs.
Figure 14:
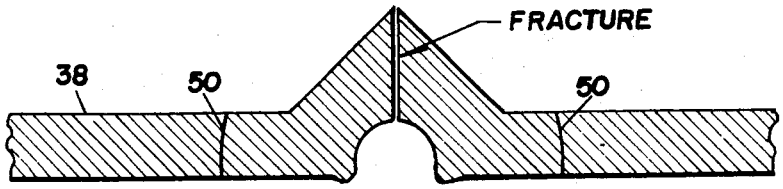
FIG. 14 is still another view similar to FIG. 10 depicting the condition upon completion of the fracture.

FIG. 13 depicts a still later stage of the compressive and tensile waves produced in plate 34 and offset 36, showing the compressive wave 50 continuing to expand to the opposite ends of plate 34 and showing the tensile waves 52 and 54 coinciding with each other along the bisector 46 of the angle formed by the offset 36, beginning at the vertex 48. As a result, each point along the length of the plane containing the bisector 46 is subjected to the destructive effects of the summated compression and tension waves. With a sufficient explosive charge 40, such destructive effects induce fracture along the bisector 46 across the width of the plate 34, as illustrated by FIG. 14.

As those skilled in the art will understand, the linear separation explosive systems of FIGS. 1–8 and FIGS. 8–14 illustrate only two of many possible configurations consisting of two intersecting surfaces formed in or on a structural plate or other member consisting of an isotropic material such as metal which are offset from each other at an angle substantially less than 180° and having a parallel explosive charge placed in such a location as to be nominally centered on the bisector of the angle formed by said offset surfaces.

Figure 15:
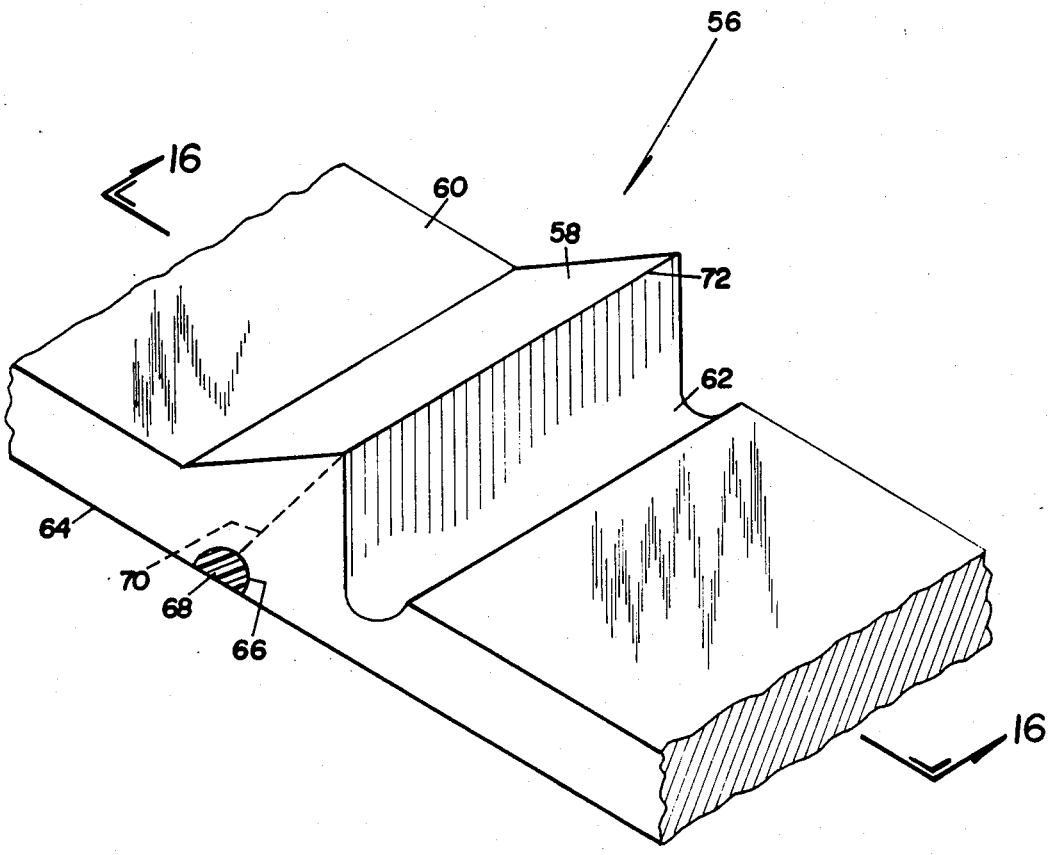
FIG. 15 is a fragmentary perspective view of still another configuration, according to the invention, of an offset plate with a linear charge explosive located in a parallel groove on the opposite side of the plate and lying nominally on the bisector of the offset and prepared for a fracturing operation.
Figure 16:
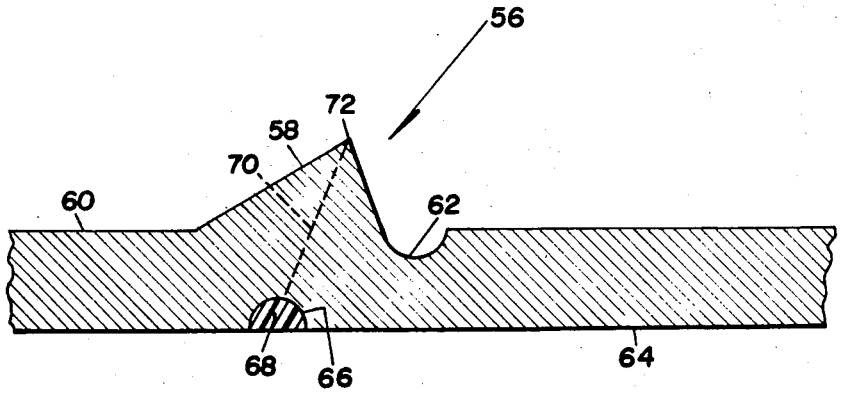
FIG. 16 is a cross sectional view taken along the lines 16—16 of FIG. 15.

Thus, the linear explosive systems of FIGS. 1–8 and of FIGS. 9–14 constitute limiting cases of the reflecting surfaces for the compressional waves. An intermediate such system is illustrated in FIGS. 15 and 16 wherein a plate 56 includes an offset 58 on one side, or first surface 60 of plate 56. Offset 58 is generally triangular, as shown in FIG. 16, but extends on the right side thereof into a groove 62 in surface 60, as seen in the drawing. On the other side or second surface 64 of the plate 58 is a groove 66 that is parallel to the offset 58. Groove 66 may be semicircular, as shown, and includes a linear explosive charge 68 therein. As illustrated in FIG. 16, the bisector 70 of the angle formed by offset 58 may be substantially perpendicular to an angle approaching 45° from the vertical, as a limit. Detonation of the explosive charge 68 results in a tensile fracture along the bisector 70, originating at the vertex 72 of the offset 58. Plate 58 may be flat or curved.

The principle of operation of the systems of Figs. 1 and 2, FIGS. 8 and 9, and FIGS. 15 and 16 is the same, the separation of the plate 10 along the bisector 24 of FIG. 1, the separation of the plate 34 along the bisector 46 of FIG. 8, and the separation of the plate 56 along the bisector 70, in each case, being caused by high tensile stress produced along the respective bisectors 24, 46 and 70 of the offsets 12, 36 and 58.

In each of the systems of FIGS. 1 and 2, FIGS. 8 and 9, and FIGS. 15 and 16, the linear explosive charges 16, 40 and 68 preferably are made of a readily formable explosive material in a manner known in the art, that is capable of maintaining intimate contact with the interior surface or surfaces of the respectively associated groove 18, 41 and 66 in order to achieve maximum transfer of energy to the solid substance of the plate in which such groove is formed. Thus, the explosive charges may be made from a soft, putty-like material which is curable to a slightly elastic solid. By way of illustration and not limitation, it is noted that a material that may be used is the explosive made and sold commercially by E. I. duPont de Nemours, Wilmington, Delaware under the trademark "detasheet." Specific explosive properties would depend upon the application. Intimate contact with the surface of the associated groove and good bonding characteristics are desirable in order to minimize the size of the explosive charge, and therefore, the localized stresses introduced by the groove when the structure is under load.

A specific application for the invention is a lightweight stage separation system for multistage rockets. Since the explosive would be outside of the interstage structure, the backblast would dissipate into the free air or vacuum. Any external sealing and insulation material would be ejected outward and away from the vehicle. While a fracture could be obtainable with the explosive external to the outer surface, this would be aerodynamically undesirable. Such a configuration, however, could be useful in other applications.

Thus, in accordance with the invention, there has been provided an improved linear explosive system for imparting directionality to an explosive energy release for the purpose of separating components of an integral structure, which system is compact and lightweight and operative to provide a single fracture line with little or no fragments and other debris thereby eliminating the need for backup or protective structures. The invention is characterized in its utilization of two intersecting surfaces that are formed in or on a structural or other member of an isotropic material such as metal, which surfaces are offset from each other at an angle substantially less than 180° and having a parallel explosive charge placed in such a location as to be nominally centered on the bisector of the angle formed by said offset surfaces.

What is claimed is:

1. A linear explosive separation system comprising, a plate of normally solid substance flowable under extreme pressure, said plate having spaced first and second surfaces with said first surface having an offset formed thereon, and said second surface having a groove formed thereon that is parallel to said offset and lying nominally centered on the bisector of the angle formed by said offset, a linear explosive charge formed in place in said groove in intimate contact with the solid substance forming said plate, and the location of the groove on the second surface of said plate being such that detonation of the explosive charge results in a tensile fracture in a plane containing the bisector of the angle formed by said offset.

2. A system as defined by claim 1 wherein said groove is positioned on said second surface in a plane that intersects the bisector of the said offset in or on the said first surface of said plate at a position spaced from said offset.

3. A system as defined by claim 1 wherein said offset comprises two intersecting surfaces formed on said first surface of said plate.

4. A system as defined by claim 1 wherein said offset comprises a step forming a substantially 90° angle in said first surface of said plate.

5. A linear explosive separation system comprising, a plate of normally solid substance flowable under extreme pressure, said plate having spaced first and second surfaces with said first surface having an offset formed thereon, said offset comprising a protuberance that is triangular is cross section and the sides of which are of substantially equal length, and said second surface having a groove formed thereon that is parallel to said offset and lying nominally centered on the bisector of the angle formed by said offset, a linear explosive charge formed in place in said groove in intimate contact with the solid substance forming said plate, and the location of the groove on the second surface of said plate being such that detonation of the explosive charge results in a tensile fracture in a plane containing the bisector of the angle formed by said offset.

* * * * *